US006742466B2

(12) United States Patent
Sano et al.

(10) Patent No.: US 6,742,466 B2
(45) Date of Patent: Jun. 1, 2004

(54) SEWING MACHINE WITH NEEDLE THREADING DEVICE

(75) Inventors: Yasuro Sano, Tokyo (JP); Eiji Murakami, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 146 days.

(21) Appl. No.: 10/192,848

(22) Filed: Jul. 11, 2002

(65) Prior Publication Data

US 2003/0019410 A1 Jan. 30, 2003

(30) Foreign Application Priority Data

Jul. 12, 2001 (JP) ..... 2001-212742

(51) Int. Cl.[7] ..... D05B 19/12; D05B 87/02
(52) U.S. Cl. ..... 112/470.01; 112/225
(58) Field of Search ..... 112/470.01, 225, 112/222, 224; 223/99

(56) References Cited

U.S. PATENT DOCUMENTS 6,564,731 B2 * 5/2003 Sano et al. ..... 112/225

FOREIGN PATENT DOCUMENTS

JP 2002-113281 4/2002

* cited by examiner

*Primary Examiner*—Peter Nerbun
(74) *Attorney, Agent, or Firm*—McGinn & Gibb, PLLC

(57) ABSTRACT

A sewing machine with needle threading device is disclosed, wherein the thread passed through the needle eye of a needle of the sewing machine by operation of a threading hook may be released from the threading hook during a process of the threading hook moving up to the upper initial position after the threading operation is finished. More precisely, the sewing machine comprising a threading shaft 2 having a threading hook 4*b* mounted to the lower end thereof, a control means CPU for providing a descending process wherein the threading shaft 2 is moved down from an upper initial position to a lower threading position where the threading hook 4*b* is operated to catch a thread to pass the thread through the needle eye and an ascending process wherein the threading shaft 2 is moved up from the lower threading position to the upper initial position, the ascending process including an initial process wherein the threading shaft 2 is moved up a predetermined distance from the lower threading position to pull up the threaded thread, a second process wherein the threading shaft 2 is moved down a predetermined distance after the initial process to have the threading hook 4*b* release the threaded thread and a final process wherein the threading shaft 2 is moved up to the upper initial position after the second process while said threaded thread is released from said threading hook 4*b*.

2 Claims, 8 Drawing Sheets

SEWING MACHINE WITH NEEDLE THREADING DEVICE

BACKGROUND OF THE INVENTION

1. Field of the Invention

The present invention relates to a sewing machine, and more particularly relates to a sewing machine provided with a needle threading device, wherein a thread passed through the needle eye of needle by a threading hook at a lower threading position may be released without fail from the threading hook holding the thread during the ascending process of the threading hook to the upper initial position.

2. Description of the Related Art

The inventors of the subject matter of this application has invented a sewing machine provided with a needle threading device which may be exactly operated to easily and rapidly pass a thread through the needle eye of the needle of the sewing machine as disclosed in the Japanese patent application No. 2000-366,159.

The threading device of prior art is further required to have a threading hook which may exactly catch the thread to be passed through the needle eye. Further, the threading hook is required to release the thread in the process for moving up to the upper initial position after the hook is operated to catch the thread and pass the thread through the needle eye. In case the thread is not released from the threading hook, the thread will give a load to the driver for moving up the hook and give an adverse influence to the threading device and to the control device.

OBJECTS OF THE INVENTION

The invention has been provided to eliminate the defects and disadvantages of the prior art.

It is, therefore, a principal object of the invention to provide a sewing machine provided with a threading device which is smoothly and exactly operated to pass a thread through the eye of needle of the sewing machine.

It is another object of the invention to provide a threading device including a threading hook which is operated to move down from an upper initial position to a lower threading position where the hook is operated to exactly catch the thread and pass the thread trough the needle eye.

It is another object of the invention to provide a control means for controlling the movement of the threading hook for the purpose of releasing the thread from the hook during movement of the hook from the lower threading position to the upper initial position for the purpose of removing the load of thread which may otherwise applied to the hook and the related mechanism.

SUMMARY OF THE INVENTION

In short, the invention relates to a sewing machine provided with a threading device, the sewing machine comprising a needle having a needle eye and attached to the lower end of a vertically reciprocating needle bar, a threading shaft having a threading hook mounted to the lower end thereof, a control means for providing a descending process wherein the threading shaft is moved down from an upper initial position to a lower threading position where the threading hook is operated to catch a thread and pass the thread through the needle eye and an ascending process wherein the threading shaft is moved up from the lower threading position to the initial upper position, the ascending process including an initial process wherein the threading shaft is moved up a predetermined distance from the lower threading position to pull up the threaded thread, a second process wherein the threading shaft is moved down a predetermined distance after the initial process to have the threading hook release the threaded thread and a final process wherein the threading shaft is moved up to the upper initial position after the second process while the threaded thread is released from the threading hook.

BRIEF DESCRIPTION OF THE DRAWINGS

FIG. 4(*b*) is an illustration showing a process for moving down the threading hook to release the thread from the threading hook.

FIG. 4(*c*) is an illustration showing a final process for moving up the threading hook.

FIG. 5(*b*) is a side elevational view of the threading device of FIG. 5(*a*) shown partly in section.

FIG. 6(*b*) is a sectioned plan elevational view of the essential parts of the threading device showing an angular position of the guide pin when the guide pin is positioned as shown in FIG. 6(*a*).

FIG. 6(*c*) is a sectioned plan elevational view of the essential parts of the threading device showing an operational relation between the threading member and the needle eye when the guide pin is positioned as shown in FIG. 6(*a*).

FIG. 7(*b*) is a same view with FIG. 6(*b*), however showing the guide pin being at another angular position when the guide pin is positioned as shown in FIG. 7(*a*).

FIG. 7(*c*) is a same view with FIG. 6(*c*), however showing another operational relation between the threading member and the needle eye when the guide pin is positioned as shown in FIG. 7(*b*).

FIG. 8(*b*) is a same view with FIG. 7(*b*), however showing the guide pin being at another angular position when the guide pin is positioned at the setting cam portion of the guide groove.

FIG. 8(*c*) is a same view with FIG. 7(*c*), however showing operational relation between the threading member and the needle eye when the guide pin is positioned as shown in FIG. 8(*b*).

FIG. 9(*b*) is a perspective view of the essential parts of threading device enlarged to show the threading hook passed through the needle eye.

FIG. 10(*b*) is a front elevational view of the indicator enlarged to show a picture for explanation of threading operation.

DETAILED DESCRIPTION OF THE PREFERRED EMBODIMENT

The invention will be described in detail in reference to the embodiment as shown in the attached drawings.

Figure 1:
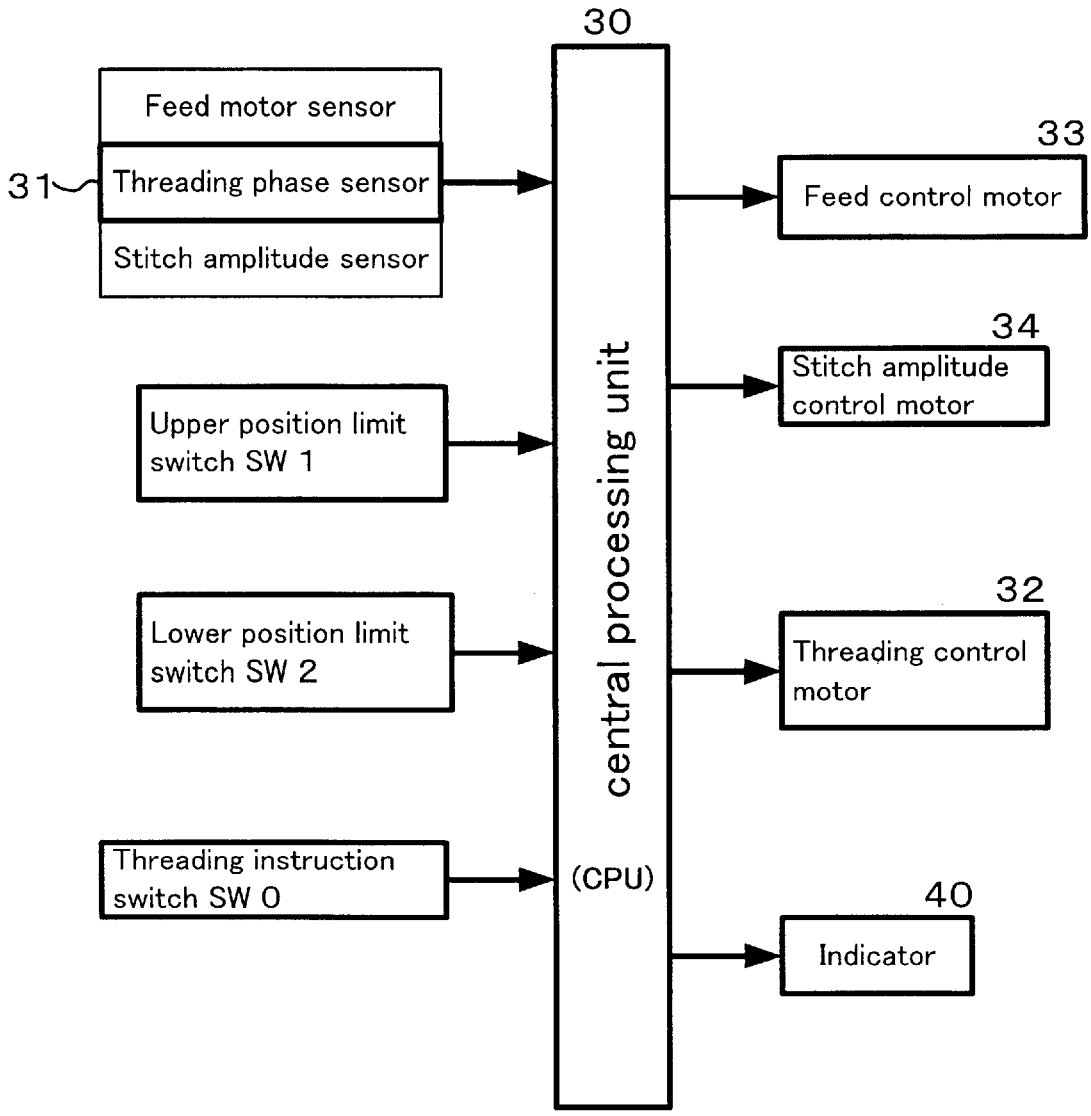
FIG. 1 is a block diagram showing the functions of a threading device of the invention.

FIG. 1 is a block diagram showing the functions of the invention including a needle threading position sensor 31 for detecting a position where the threading operation may be performed, a needle threading instruction switch SWO for instructing the threading operation, an upper position limit switch SW1 for detecting an upper limit position of the threading device, a lower position limit switch SW2 for detecting a lower limit position for threading operation, a central processing unit (CPU) 30 which is operated in response to the signals from the sensor and switches to control the operation of a threading control motor 32 for controlling the threading operation.

The invention further includes an indicator 40 for showing the contents of control for threading operation. The needle threading position sensor 31 is operated to detect the threading position in cooperation with a feed control motor 33 and a stitch amplitude control motor 34. The sensor 31 may be a sensor which is generally used to detect the rotation phases of upper main shaft of the sewing machine.

Figure 5:
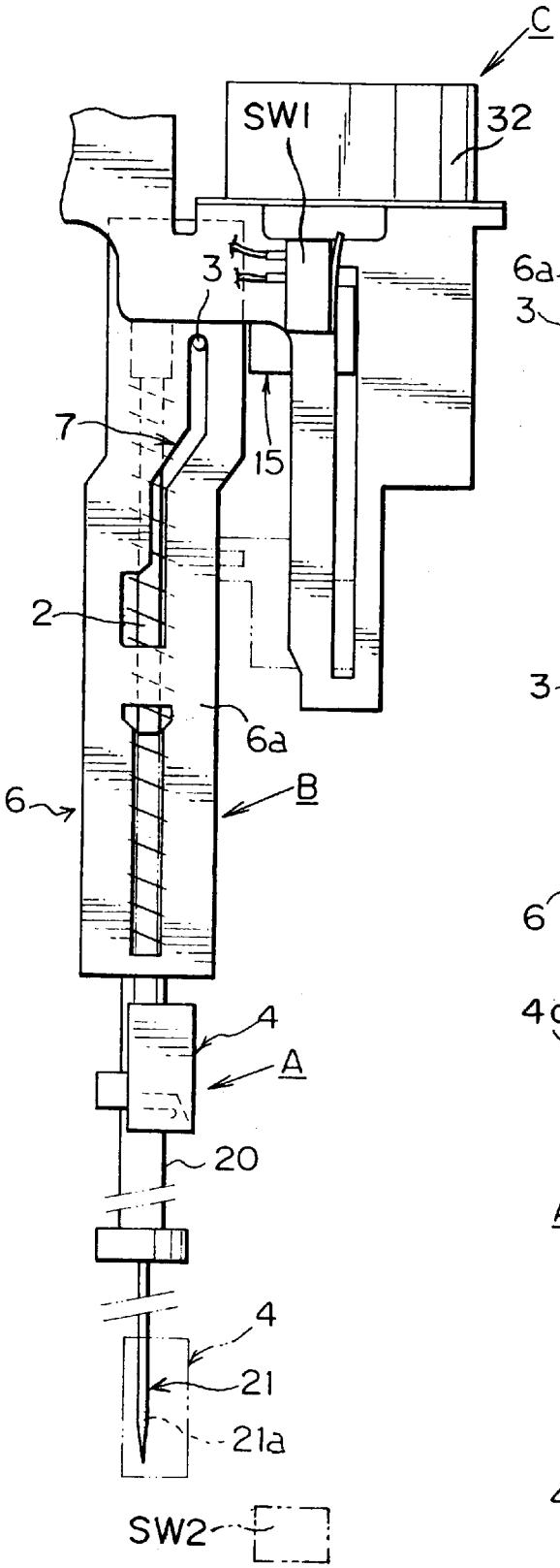
FIG. 5(*a*) is a front elevational view of the threading device of the invention showing a threading member having the threading hook at an upper initial position.
Figure 5:
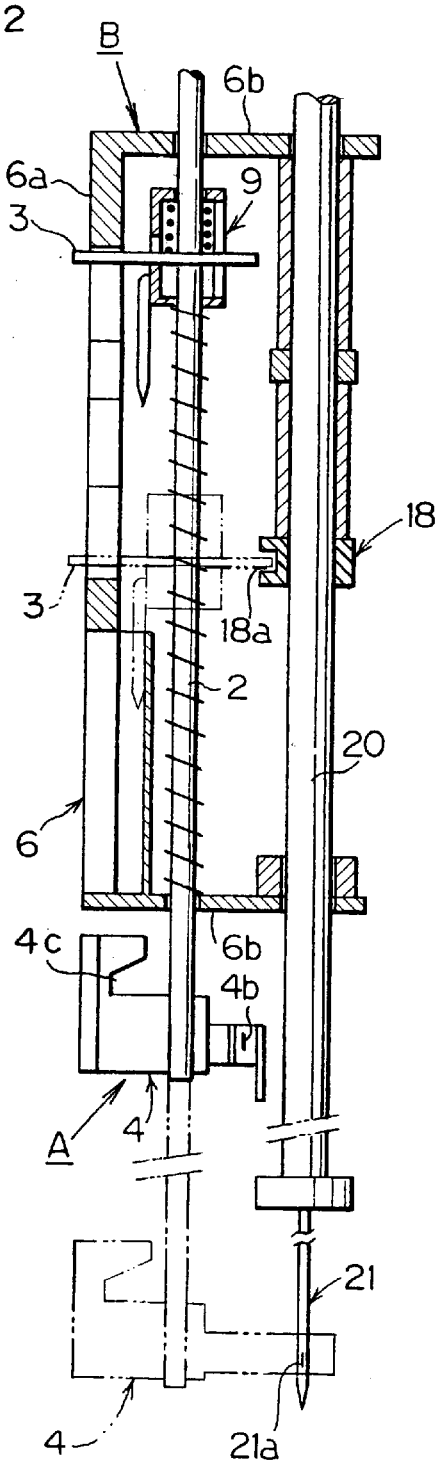

As shown in FIGS. 5(*a*) and (*b*), the needle threading device substantially comprises a threading structure A, a support body B mounted to a needle bar holder of the sewing machine and supporting the threading structure A and a driver C for vertically moving the threading structure A on the threading structure support body B and along a needle bar 20 which may be vertically reciprocated on the needle bar holder.

The threading structure A comprises a vertically extending threading shaft 2, a laterally extending guide pin 3 secured to the threading shaft 2 and a threading member 4 having a hook 4*b* and mounted to the lower end of the threading shaft 2.

Further there are provided a limit switch SW2 for detecting a lower limit stop position of the threading member 4 and a means for rotating the threading member 4 to pass the hook 4*b* through a needle eye 21*a* of a needle 21 which is mounted to the lower end of the needle bar 20.

The support body B comprises a vertically extending support frame 6 formed with a vertically extending wall 6*a* having a vertically extending guide groove 7 of cam type formed thereat and laterally extending walls 6*b*, 6*b* formed at the upper and lower ends of the vertically extending wall 6*a* respectively for movably supporting the threading shaft 2.

The guide pin 3 has one end portion thereof inserted into the guide groove 7 so that the threading shaft 2 may be vertically moved along the guide groove 7 as it is guided by the guide groove 7.

The driver C is mounted to a part of machine frame and comprises a threading control motor 32, a threaded shaft 14 and a drive portion 15 for vertical moving the threading shaft 2.

With the construction of the needle threading device, the threading structure A is operated in a descending process wherein the threading shaft 2 is moved down from an upper initial position to a lower threading position where the hook 4*b* is operated to pass through the needle eye 21*a*, and is further operated in an ascending process wherein the threading shaft 2, that is, the threading hook 4*b* is moved up from the lower threading position to the upper initial position.

Figure 3:
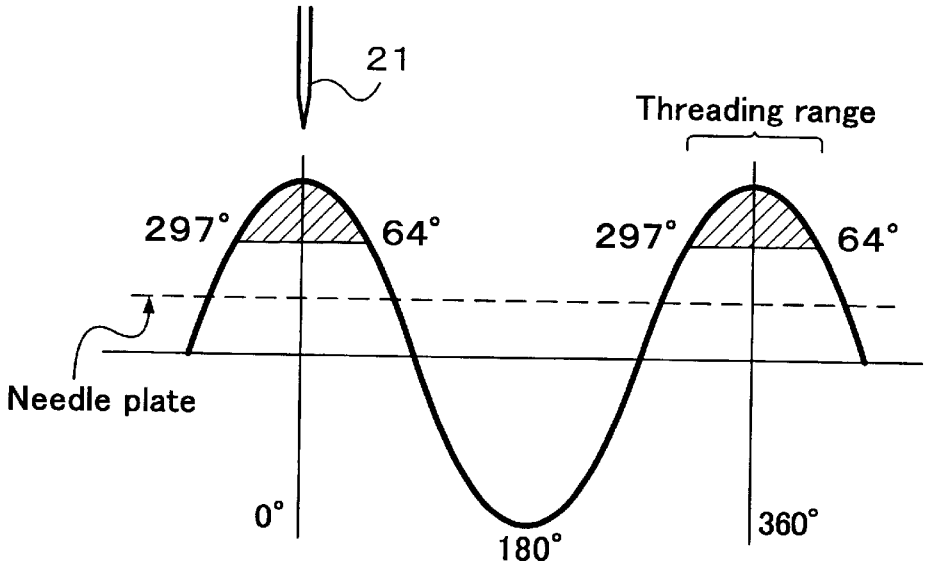
FIG. 3 is a graphic representation showing the relation between the needle position and the rotation angle of upper main shaft of the sewing machine.
Figure 4:
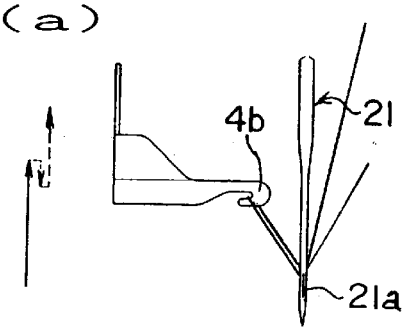
FIG. 4(*a*) is an illustration showing an initial process for moving up a threading hook to pull up the threaded thread.
Figure 4:
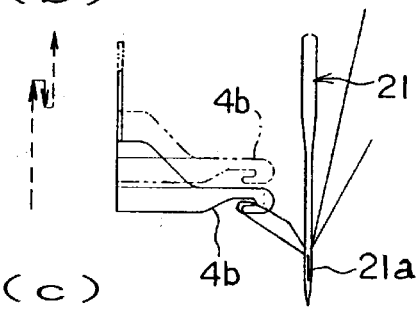
Figure 4:
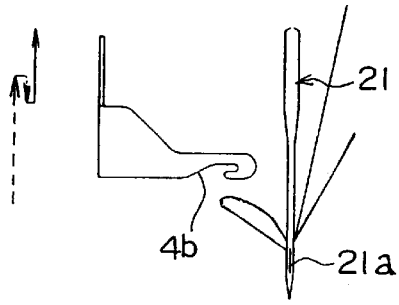

In case of the needle threading operation initiated with the needle threading instruction switch SW0 turned ON, it is required that a threading range is provided where threading operation may be performed, that is, the threading position sensor 31 is in the state of turned ON. The threading range is about 6 mm down from the upper dead point of the needle bar, that is, the range of rotation phase angle 297°~64° of the upper main shaft as shown in FIG. 3.

In the prior art, it often happens that the hook 2 fails to let the thread free from the hook 4*b* when the hook 4*b* is moved up after it catches the thread, thereby to disturb the operation of the threading shaft 2.

Therefore, according to the invention, in the ascending process, the threading shaft 2 is moved up a predetermined distance (about 20 mm) from the lower threading position and subsequently is moved down a predetermined distance (about 2 mm) so as to release the thread from the hook 4*b* and subsequently is moved up to the upper initial position while the thread is released from the hook 4*b*, thereby to remove the load from threading shaft 2 which may otherwise be applied to the threading shaft 2.

Figure 2:
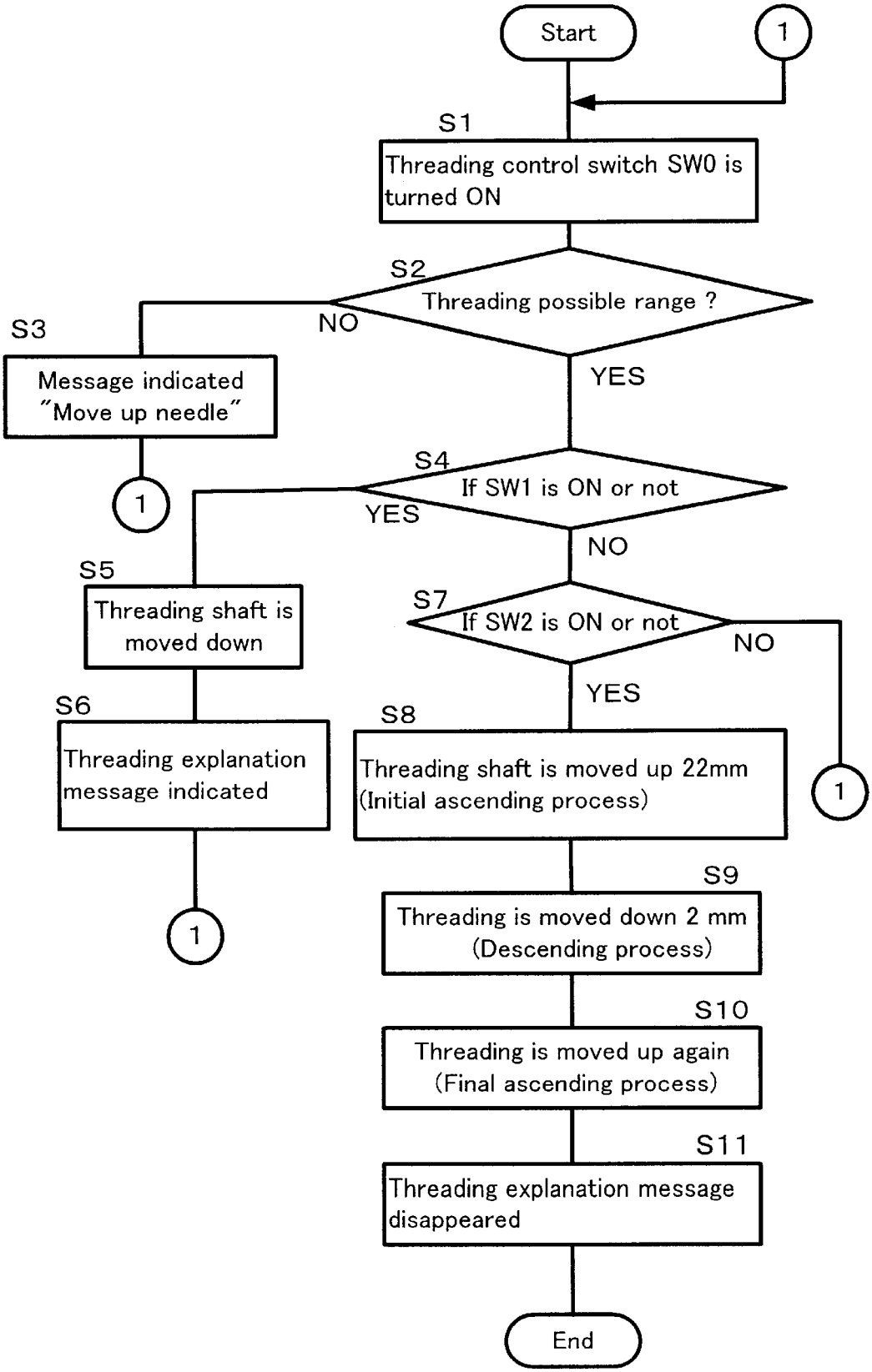
FIG. 2 is a flow chart showing the sequences of control for threading operation.

The threading operation will be described in reference to the flow chart as shown in FIG. 2.

At first, the needle threading instruction switch SW0 is turned ON to provide a threading mode (S1). Subsequently it is discriminated if the threading phase is provided or not (S2). If the needle is located at a lower position where the threading operation can not be performed, that is, in the state of NO, a message "move up the needle" is indicated (S3), and the program is returned to ①.

On the contrary, if the needle is at an upper position, it is discriminated if the upper position limit switch SW1 is in the state of turned ON or not (S4). In case the switch SW1 is in the state of turned ON, the threading shaft 2 is moved down to the lower threading position where the hook 4*b* may pass through the needle eye 21*a* and the thread may be hung so as to be caught by the hook 4*b* when the hook 4*b* is pulled out of the needle eye 21*a* (S5). Then a message for threading operation is indicated (S6), and the program is returned to ① again.

In case the switch SW1 is in the state of turned OFF, it is discriminated if the lower position limit switch SW2 is in the state of turned ON or not (S7).

In case the switch SW2 is in the state of turned ON, the ascending process of threading operation is started. The threading shaft 2 is moved up a predetermined distance (for example, 22 mm) as an initial ascending process (S8), thereby to tighten the thread loop which is held by the hook 4*b*.

Subsequently the threading shaft 2 is slightly moved down a predetermined distance (for example, 2 mm) as the descending process (S9). Then the thread loop held by the hook 4*b* is loosened and released from the hook 4*b*.

Subsequently the threading shaft 2 is moved up again to the upper initial position as a final ascending process (S10). Thus the needle threading operation is finished.

Figure 6:
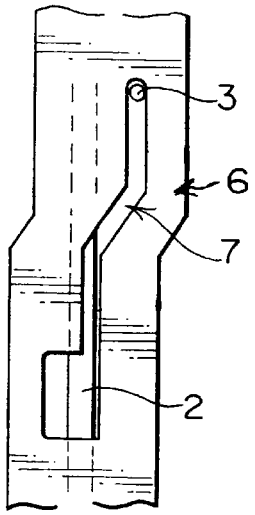
FIG. 6(*a*) is a partly enlarged view of the essential parts of the threading device of the invention showing a guide pin being at an upper most position of a guide groove.
Figure 6:
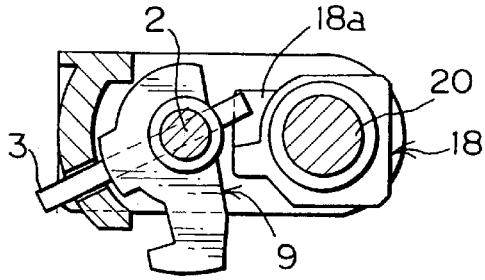
Figure 6:
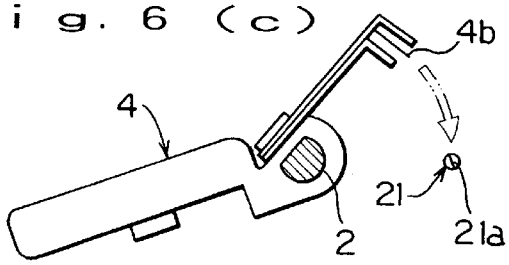

Here, in reference to FIGS. 5 and 6(*a*)~(*c*), it will be necessary to describe the threading operation which is performed before the threading shaft 2 is moved up from the lower threading position in the ascending process after the thread is passed through the needle eye 21*a*.

In the initial stage, the threading shaft 2 is held at the upper initial position where the guide pin 3 is at the upper end of the guide groove 7 and the threading member 4 is at an upper position with respect to the needle bar 20.

When the threading control motor 32 is driven, the threaded shaft is rotated to move down the drive member 15. At the same time, the upper position limit switch SW1 is operated to confirm the descending movement of the threading shaft 2. With the drive member 15 driven to move down, the guide member 9 is moved down, the guide member 9 being mounted to the threading shaft 2 and connected to the drive member 15.

Figure 7:
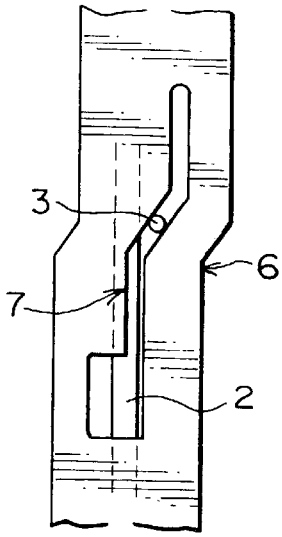
FIG. 7(*a*) is a same view with FIG. 6(*a*), however showing the guide pin being positioned at the inclined part of the guide groove.
Figure 7:
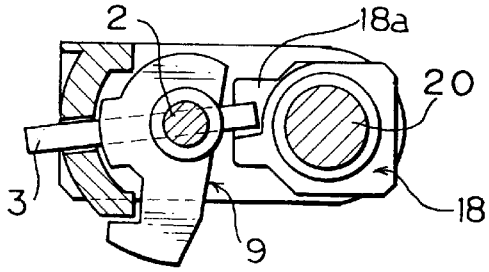
Figure 7:
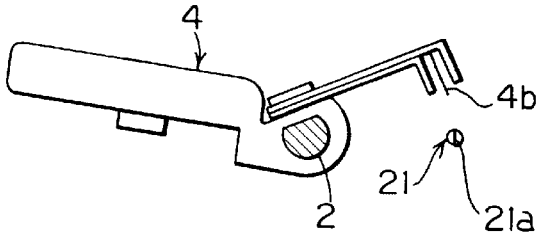

As the guide member 9 is moved down, the threading shaft 2 is moved down as it is guided by the guide groove 7 which is in engagement with the guide pin 3 of the threading shaft 2 as shown in FIG. 7(*a*).

Figure 8:
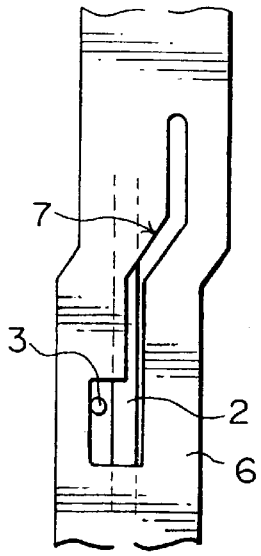
FIG. 8(*a*) is a same view with FIG. 7(*a*), however showing the guide pin being positioned at a setting cam portion of the guide groove.
Figure 8:
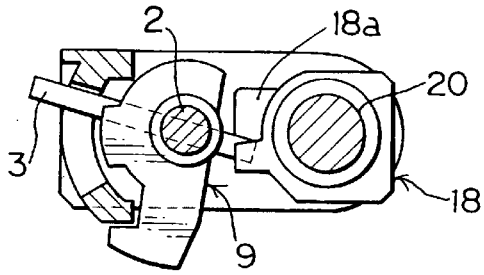
Figure 8:
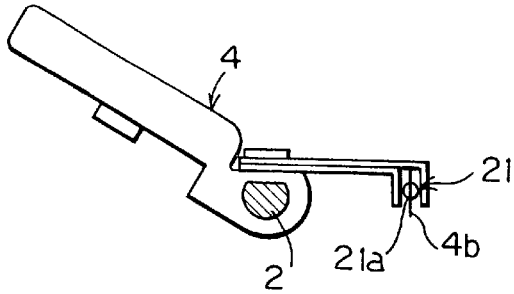
Figure 9:
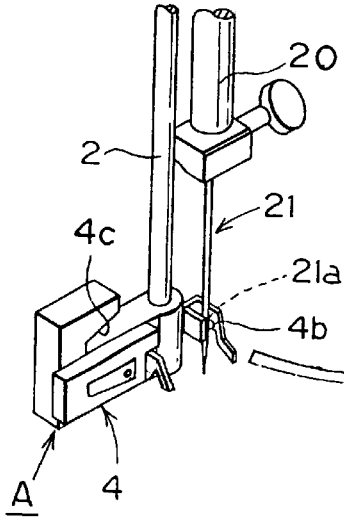
FIG. 9(*a*) is a perspective view of the threading device showing the threading hook passed through the needle eye.
Figure 9:
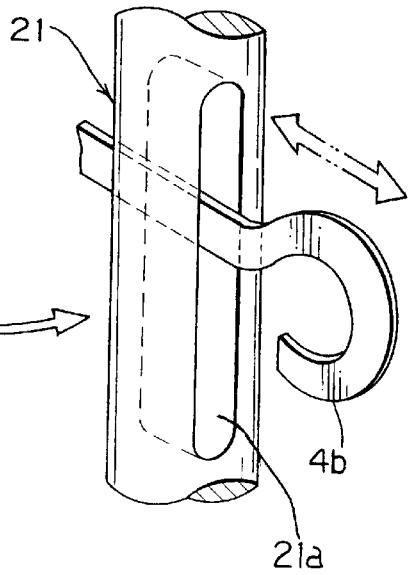
Figure 10:
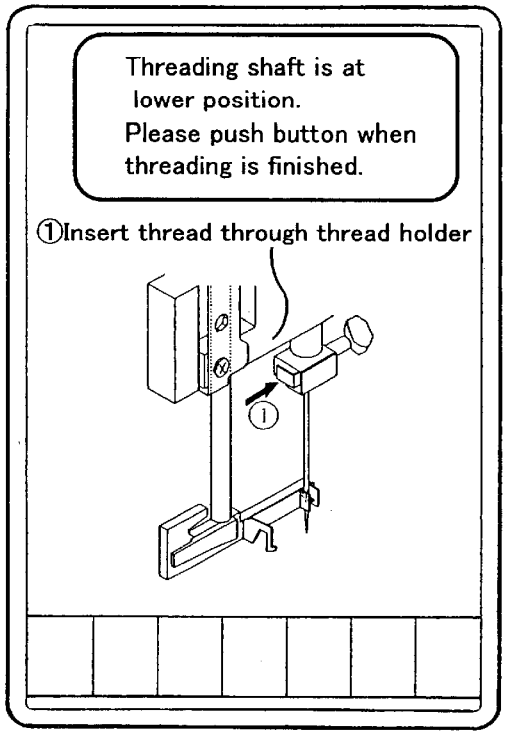
FIG. 10(*a*) is a perspective view of a sewing machine having an indicator provided thereon in connection with the threading device.
Figure 10:
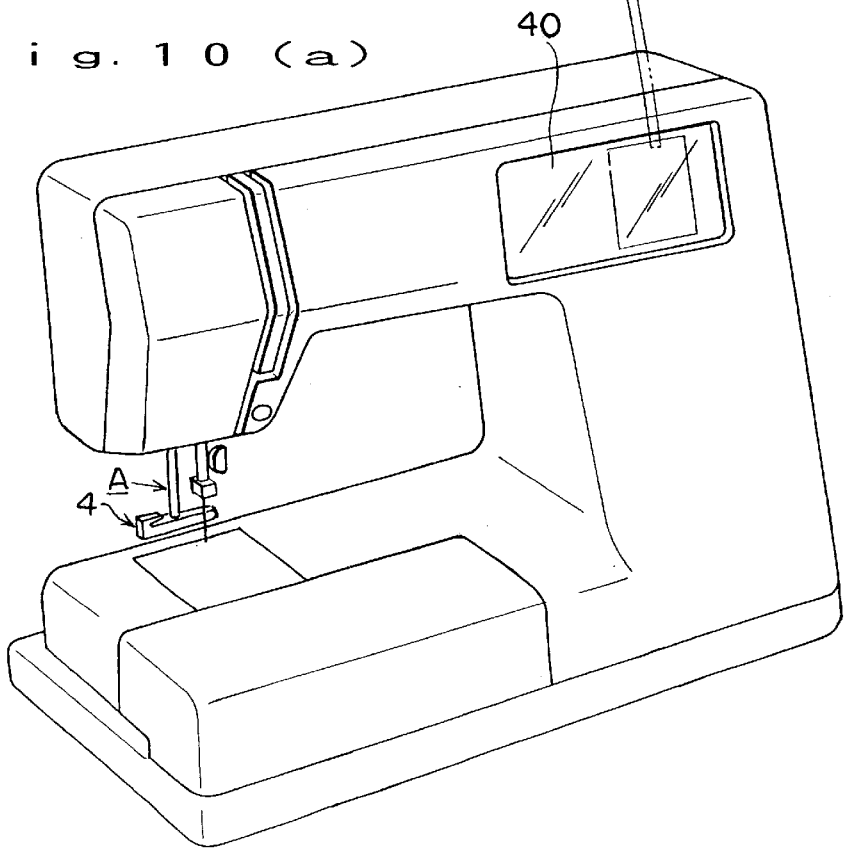

With further downward movement of the threading shaft 2, the guide pin 3 comes to a specific cam portion at the lower end portion of the guide groove 7 as shown in FIG. 8(*a*) where the threading shaft 2, that is, the threading member 4 having the threading hook 4*b* is stopped at a predetermined height position corresponding to the height of the needle eye 21*a* while the opposite end of the guide pin 3 is in engagement with the slide surface 18*a* of the regulating member 18 which is mounted to the needle bar 20 so as to determine the predetermined height position of the threading hook 4*b*.

With further downward movement of the guide member 9, the threading shaft 2 is rotated by way of the guide pin 3 as shown in FIG. 8(*b*).

As the threading shaft 2 comes from the descending range to the rotating range where the guide pin 3 contacts the slide surface 18*a* of the regulating member 18, the guide member 9 is stopped. In the meantime, the threading control motor 32 is driven again with a predetermined number of rotations.

The predetermined number of rotations of the motor 32 will further move down the guide member 9 to rotate the threading shaft 2 by way of the guide pin 3, thereby to pass the threading hook 4*b* through the needle eye 21*a*. Thus the hook 4*b* is positioned to catch the thread which is hung so as to be caught by the hook 4*b* as shown in FIGS. 8(*c*) and 9(*a*) and (*b*). The threading control motor 32 is stopped until the next signal is produced to move up the threading shaft 2.

Figure 11:
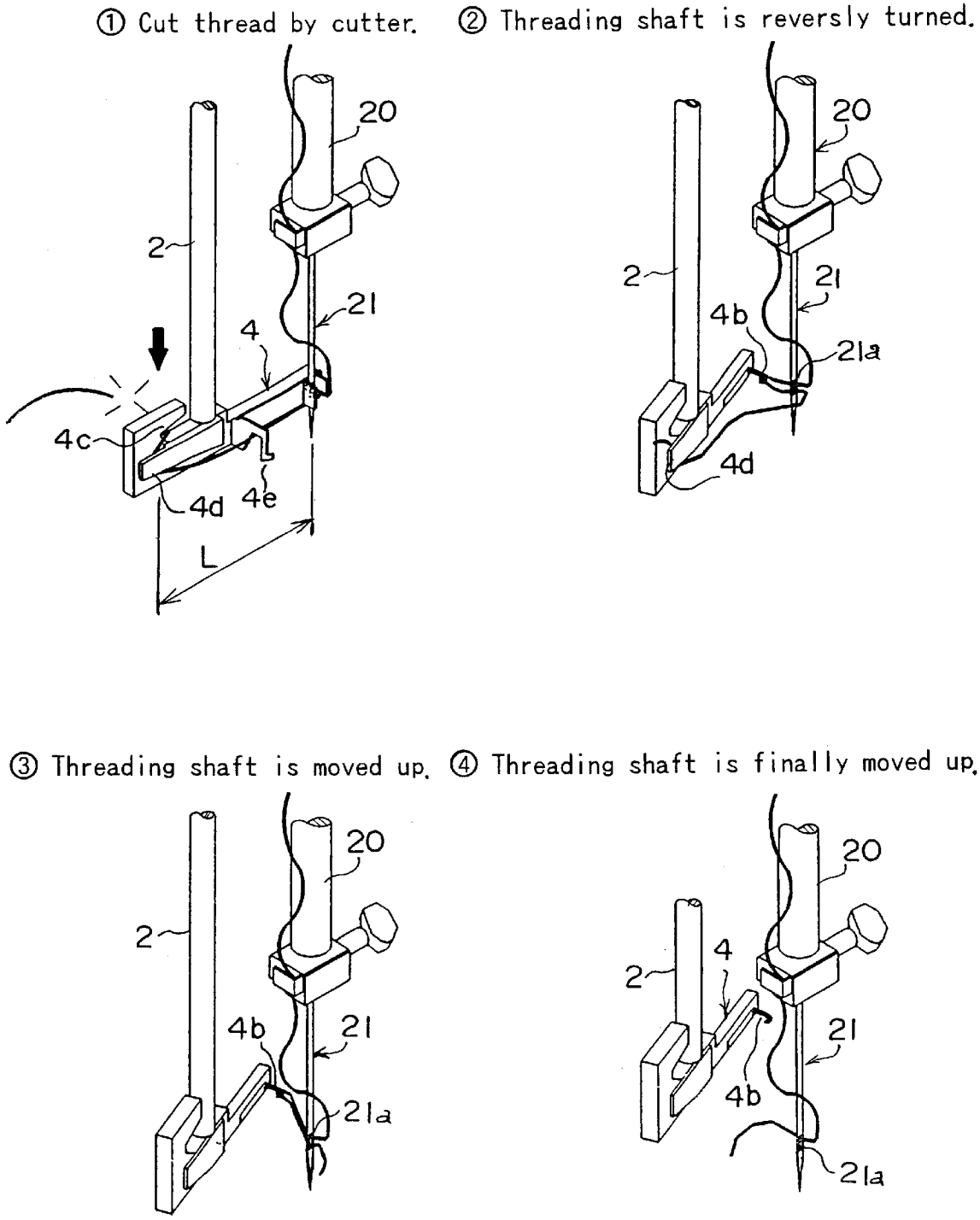
FIG. 11 ① through ④ are perspective views showing a series of threading operations wherein the threading hook is operated to pass the thread through the needle eye and is moved up.

Subsequently the machine user hangs the thread extending from the thread source, wherein the end portion of the thread is held by a holder of the threading member 4. The spare thread is then cut off by the cutter 4*c* which is provided at the threading member 4 as shown in FIG. 11①. The distance between the cutter 4*c* and the needle eye 21*a* is designed to provide a sufficient amount of thread after thread cutting so as to prevent the thread from pulling out of the needle eye 21*a* when stitching is started.

The threading shaft, that is, the threading member 4 is moved up after the thread is hung onto the hook 4*b* and is cut off. Namely, the threading instruction switch SW0 is operated. As shown in the flow chart of FIG. 2, it is discriminated if the upper position limit switch SW1 is ON or OFF. In case the switch SW1 is OFF, it is confirmed that the threading shaft 2 is at the lower position.

Subsequently it is discriminated if the lower position limit switch SW2 is ON or OFF. In case the switch SW2 is ON, the latter half of ascending process of threading operation is performed. Namely, the threading control motor 32 is reversely rotated to move up the guide pin 3 along the inclined part of the cam groove 7, thereby to rotate the threading shaft 2, that is, the threading member 4, thereby to retreat the hook 4*b* out of the needle eye 21*a* as shown in FIG. 11②.

The retreating rate is controlled by the threading control motor 32 such that the threading member 4 is moved up while the threading hook 4*b* catches the thread, and subsequently the threading member 4 is slightly moved down so that the thread may be released from the hook 4*b*.

As shown in FIG. 11③, the principal theme of the invention is to control the ascending process of the threading shaft 2 after the thread is passed through the needle eye 21*a*. The threading operation is finished when the threading shaft 2 is returned to the upper initial position when the threading shaft 2 is returned to the upper initial position as it moves up as guided by the guide groove 7 from the lower threading position, wherein the upper position limit switch SW1 is turned ON to confirm the return of threading shaft 2 to the upper initial position, and then the threading control motor 32 is stopped as shown in FIG. 11 ④. Incidentally, the series of threading operations are indicated at the indicator 40 which is provided on the sewing machine.

EFFECTS OF THE INVENTION

According to the invention as described above, the threading device is so formed as to include a threading shaft having a threading member having a hook, wherein the threading shaft is moved up a predetermined distance and is then moved down a predetermined distance during the ascending process to the initial upper position after the thread is inserted through the needle eye. Therefore, the hook may be so formed as to hold the thread with certainty for the purpose of passing the thread through the needle eye, and the hook may release the thread during the ascending process of the threading shaft. Thus, the load of thread which may otherwise be applied to the threading shaft may be removed during the ascending process of the threading shaft.

The invention being thus described, it will be obvious that the same may be varied in many ways. Such variations are not to be regard as a departure from the spirit and scope of the invention, and all such modifications are intended to be included within the scope of the following claims.

What is claimed is:

1. A sewing machine with needle threading device which is automatically operated to thread an needle eye of a needle attached to the lower end of a vertically reciprocating needle bar, said sewing machine comprising a threading shaft having a threading hook mounted to the lower end thereof, a control means for providing a descending process wherein said threading shaft is moved down from an upper initial position to a lower threading position where said threading hook is operated to catch a thread and pass the thread through said needle eye and an ascending process wherein said threading shaft is moved up from said lower threading position to said upper initial position, said ascending process including an initial process wherein said threading shaft is moved up a predetermined distance from said lower threading position to pull up the threaded thread, a second process wherein said threading shaft is moved down a predetermined distance after said initial process to release the threaded thread from said hook and a final process wherein said threading shaft is moved up to said upper initial position after said second process while said threaded thread is released from said threading hook.

2. The sewing machine as defined in claim 1, wherein said ascending process is performed under an ascent instruction signal which is produced by switching operation of a machine user.

* * * * *